US005920332A

United States Patent [19]

Brooks

[11] Patent Number: 5,920,332

[45] Date of Patent: Jul. 6, 1999

[54] INK BARRIER FOR FLUID RESERVOIR VACUUM OR PRESSURE LINE

[75] Inventor: Jeffrey B. Brooks, Keene, N.H.

[73] Assignee: Markem Corporation, Keene, N.H.

[21] Appl. No.: 08/641,109

[22] Filed: Apr. 29, 1996

Related U.S. Application Data

[60] Continuation-in-part of application No. 08/556,255, Nov. 13, 1995, which is a division of application No. 08/057,091, May 4, 1993, Pat. No. 5,489,925.

[51] Int. Cl.[6] ..... B41J 2/175

[52] U.S. Cl. ..... 347/85

[58] Field of Search ..... 347/6–7, 17, 85–89, 347/92, 93, 104, 37; 137/587, 590; 138/177, 178

[56] References Cited

U.S. PATENT DOCUMENTS

| | | | |
|---|---|---|---|
| 2,711,252 | 6/1955 | Oliver | 137/587 |
| 3,123,249 | 3/1964 | Gorand et al. | 137/587 |
| 4,007,684 | 2/1977 | Takano et al. | 347/89 |
| 4,370,418 | 1/1983 | Koopman et al. | 137/590 |
| 4,462,307 | 7/1984 | Wells | 99/386 |
| 4,471,364 | 9/1984 | Kocot | 347/87 |
| 4,491,433 | 1/1985 | Shiurila et al. | 400/471.1 |
| 4,539,568 | 9/1985 | Lewis et al. | 347/88 |
| 4,658,273 | 4/1987 | Yuki et al. | 347/86 |
| 4,709,249 | 11/1987 | Hanagata | 347/85 |
| 4,791,438 | 12/1988 | Hanson et al. | 347/87 |
| 4,931,811 | 6/1990 | Cowger et al. | 347/87 |
| 4,931,812 | 6/1990 | Dunn et al. | 347/87 |
| 4,938,037 | 7/1990 | Carlisle, Jr. | 137/590 |
| 4,961,081 | 10/1990 | Shiga | 347/88 |
| 5,039,999 | 8/1991 | Winslow et al. | 347/87 |
| 5,223,860 | 6/1993 | Loofbourow et al. | 347/88 |
| 5,276,468 | 1/1994 | Deur et al. | 347/17 |
| 5,363,130 | 11/1994 | Cowger et al. | 347/92 |
| 5,386,224 | 1/1995 | Deur et al. | 347/7 |
| 5,408,257 | 4/1995 | Hiramatsu et al. | 347/92 |
| 5,489,925 | 2/1996 | Brooks et al. | 347/85 |

FOREIGN PATENT DOCUMENTS

| | | | |
|---|---|---|---|
| 64183 | 3/1994 | Japan | 347/92 |

*Primary Examiner*—N. Le
*Assistant Examiner*—L. Anderson
*Attorney, Agent, or Firm*—Baker & Botts, L.L.P.

[57] ABSTRACT

In the particular embodiment described in the specification, an ink jet printhead has a linear array of orifices and is adapted to be mounted in three mutually orthogonal orientations to eject ink drops from the orifices in horizontal or vertical directions. The printhead includes a reservoir for supplying ink to the orifices and the outlet from the reservoir is positioned below the level of ink in the reservoir in each of the orientations of the ink jet printhead. A reservoir vent is located above the level of the ink in each of the reservoir orientations and a U-shaped tube within the reservoir has one end connected to the vent and another end which is open to the interior of the reservoir at a location which is above the level of the ink in each of the reservoir orientations. The U-shaped tube extends downwardly along one wall of the reservoir and along the bottom of the reservoir so that at least a portion of the U-shaped tube is disposed below the minimum level of the ink in the reservoir in each of the reservoir orientations.

17 Claims, 3 Drawing Sheets

INK BARRIER FOR FLUID RESERVOIR VACUUM OR PRESSURE LINE

REFERENCE TO RELATED APPLICATIONS

This application is a continuation-in-part of the Brooks et al. application Ser. No. 08/556,255 filed Nov. 13, 1995, which is a division of application Ser. No. 08/057,091 filed May 4, 1993, now U.S. Pat. No. 5,489,925.

BACKGROUND OF THE INVENTION

This invention relates to barriers for preventing ink from escaping from an ink reservoir to which a vacuum or pressure line is connected.

In many ink jet systems, an ink jet printhead contains a reservoir from which ink is supplied to pressure chambers for ejecting ink drops through an array of orifices in response to drop-ejecting signals. As the ink in the reservoir is used, air is drawn into the reservoir through a vent. Moreover, to prevent weeping of ink through the ink jet orifices to which the reservoir is connected, a small negative pressure is usually applied to the reservoir vent and, to purge contaminated ink from the ink jet orifices, a positive pressure is applied to the vent.

In certain cases, an ink jet printhead must be arranged to operate in different orientations, e.g. with the array of orifices aligned in a generally horizontal direction and ejecting drops in a generally horizontal direction, or with the array of orifices aligned in a generally vertical direction and oriented to eject drops horizontally or with the array of orifices aligned in a generally horizontal direction and oriented to eject drops vertically in the downward direction. In an ink jet printhead adapted for use in such a variety of orientations, however, care must be taken to prevent ink from flowing into the reservoir vent or the associated pressure or vacuum line not only in each of the orientations during normal use, but also when the ink jet printhead is completely inverted or shaken during handling.

In order to prevent ink from reaching a reservoir vent, the Yuki et al. U.S. Pat. No. 4,658,273 provides a labyrinth passage containing spaced barrier walls leading to a chamber from which the vent opens to the atmosphere. In the Deur et al. U.S. Pat. Nos. 5,276,468 and 5,386,224, a U-shaped air path extends between an ink reservoir and a vent for the purpose of trapping impurities in the air entering the vent before it reaches the reservoir. The Cowger et al. U.S. Pat. No. 4,931,811 shows labyrinthine spiral and U-shaped paths intended to isolate a liquid valve from the atmosphere and from an ink reservoir, respectively. In that patent the U-shaped paths have a dimension small enough that ink will form a complete meniscus across the cross-section at any location in the passage so that the portion of the passage receiving ink is completely filled with ink. Moreover, the passage is long enough so that any ink which has been drawn into the ink passage will flow back into the ink jet reservoir when the pressure in the reservoir is reduced. None of the prior art, however, discloses a reservoir arrangement for preventing ink from a reservoir to escape through a vent or vacuum or pressure line connected to the reservoir when the printhead is oriented in any of three mutually orthogonal orientations.

SUMMARY OF THE INVENTION

Accordingly, it is an object of the present invention to provide an ink barrier for a reservoir vacuum or pressure line which overcomes the disadvantages to the prior art.

Another object to the invention is to provide an ink barrier for a reservoir vent connected to a vacuum or pressure line which permits the printhead to be positioned in any of three mutually orthogonal orientations without allowing ink to escape through the vacuum or pressure line.

These and other objects of the invention are attained by providing a reservoir having a vent to which a pressure or vacuum line may be connected and providing a U-shaped tube within the reservoir having one end connected to the vent and the other end open to the air in the reservoir and located at a level which is above the maximum liquid level within the reservoir when the reservoir is in any of three mutually orthogonal orientations and wherein the bottom of the U-tube is located below the minimum level of ink in the reservoir in each of the mutually orthogonal orientations.

In order to make certain that any ink which enters the open end of the U-tube when the reservoir is shaken or inverted during handling will not pass into the vent or the vacuum or pressure line, the inner diameter of the passage within the U-tube is small enough to cause the ink to form a plug, preventing passage of air. As a result, when ink is withdrawn from the reservoir during operation of the ink jet head, the resulting reduction of air pressure within the reservoir will draw any ink which has entered the U-tube passage to be back into the reservoir.

BRIEF DESCRIPTION OF THE DRAWINGS

Further objects and advantages of the invention will be apparent from a reading in the following description in conjunction with the accompanying drawings in which.

DESCRIPTION OF PREFERRED EMBODIMENTS

Figure 1:
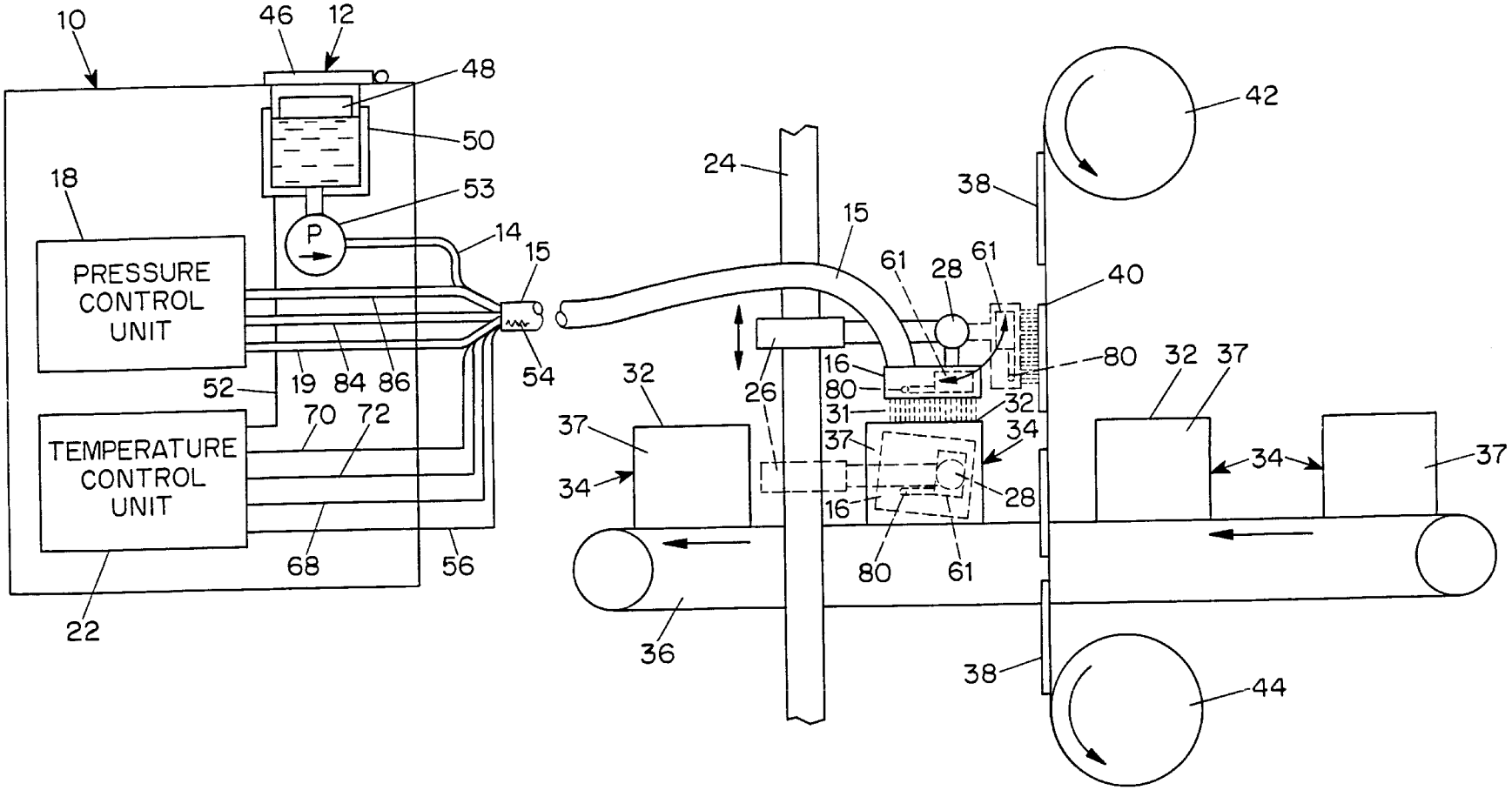
FIG. 1 is a schematic view illustrating a representative embodiment of ink jet printhead containing a reservoir with an ink barrier in accordance with the invention.

The ink reservoir of the present invention is intended for use in an ink jet printing system such as described in U.S. Pat. No. 5,489,925 in which an ink jet printhead may be operated in any of three mutually orthogonal orientations. A typical ink jet system of that type, shown in FIG. 1, includes a main control unit 10 containing a remote ink supply reservoir 12 which is connected through an ink supply conduit 14 in a cable 15 to an ink jet printhead 16 and a pressure control unit 18 which is connected to the ink jet printhead 16 through an air conduit 19, also carried by the cable 15. In addition, the main control unit 10 includes a temperature control unit 22 for controlling the temperature of hot melt ink in various portions of the ink jet system.

To facilitate positioning of the printhead 16 adjacent to different types of objects to which printing is to be applied, the printhead is movably supported on a vertically disposed column 24 so as to be locked by a clamp 26 at any desired vertical position on the column. In addition, the printhead 16 is supported for pivotal motion in any vertical plane by a clampable universal joint 28 so that the printhead can be oriented to permit a linear array of ink jet orifices 30 therein, best seen in FIG. 2, to project ink horizontally, either in a horizontal line or in a vertical line, or downwardly.

In accordance with conventional practice, the line of orifices 30 is inclined at an angle to the direction of motion of objects which are to receive an image in order to increase the image resolution, i.e., decrease the adjacent line spacing in the image. In the arrangement shown in the drawings, the objects to be printed pass in a generally horizontal direction with respect to the orientation of the printhead 16 shown in FIG. 2, but the angular orientation of the printhead may be varied to increase or decrease the resolution. In making such orientation adjustments, however, care should be exercised to make certain that the open end 92 of the U-shaped tube discussed hereinafter is above the level of the ink in the reservoir.

In the arrangement illustrated in FIG. 1, the printhead is disposed with the surface containing the printhead orifices 30 (shown in FIG. 2) in a horizontal orientation as shown in solid lines to cause the orifices to project a train of ink drops 31 downwardly onto the top surfaces 32 of a series of containers 34 which are conveyed in the horizontal direction by a conveyor 36, thus permitting appropriate information to be printed on the top surface of each of the containers. If desired, as shown in dotted lines in FIG. 1, the printhead can be lowered on the column 24 and the universal joint 28 can be arranged to clamp the head 16 in an orientation corresponding to that shown in FIG. 2 but with the array of orifices 30 facing the near sides 37 of the containers 34, so as to cause information to be printed on the near side of each of the containers as they are conveyed past the printhead by the conveyor 36.

In still another printhead position, the printing system of the invention may be arranged to print a series of labels 38 conveyed on a tape 40 in a vertical direction from one reel 42 to another reel 44 by adjusting the universal joint 28 to clamp the printhead in a vertical orientation, as shown in dotted outline in FIG. 1, so that the array of orifices 30 faces the labels 38 as they are conveyed in the vertical direction.

The ink supply reservoir 12 in the main control unit 10, which has a sealing cover 46, is arranged to receive a block 48 of solid hot melt ink and has a thermostatically controlled heater 50 connected by a line 52 to the temperature control unit 22. The temperature control unit 22 is arranged to control the heater 50 so as to heat the block of hot melt ink 48 sufficiently to melt it and to maintain the ink in the supply reservoir 12 at a temperature just above its melting point so that it is sufficiently liquid that it can be transferred by a pump 53 through the supply conduit 14 to the printhead 16 as required. At the same time, the ink temperature in the supply reservoir 12 is kept low enough so that no appreciable degradation will take place even though the ink is maintained continuously at that temperature for several days or weeks. Similarly, the ink supply conduit 14 contains a thermostatically controlled heater 54 connected through a line 56 to the temperature control unit 22 so that the ink in the supply line is also maintained continuously in liquid condition, but at a temperature low enough that no appreciable degradation occurs.

Figure 2:
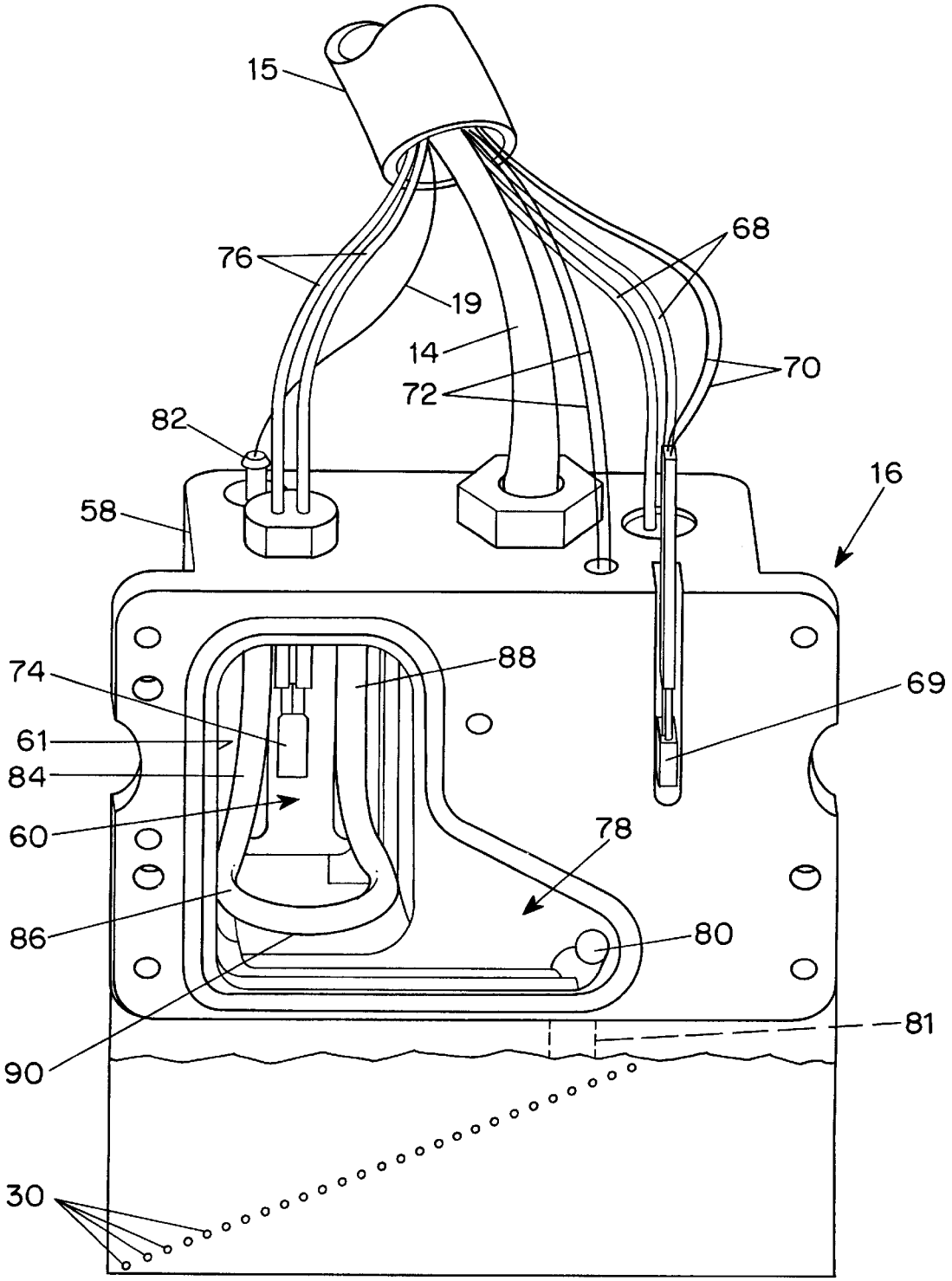
FIG. 2 is a perspective side view of the ink jet printhead of FIG. 1 with one wall of the reservoir removed to illustrate the interior arrangement thereof.
Figure 3:
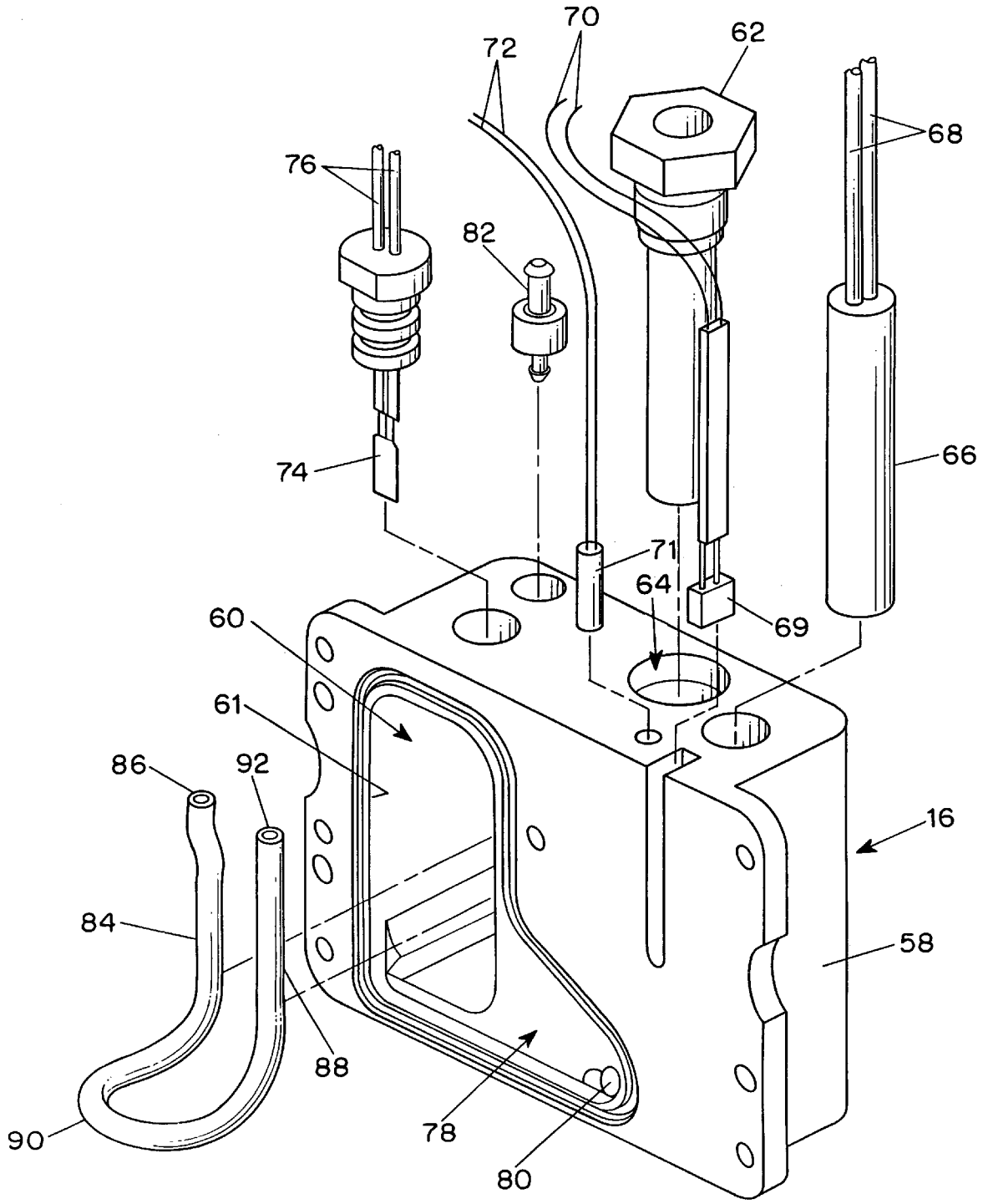
FIG. 3 is a perspective exploded view of the arrangement shown in FIG. 2 illustrating the components which are assembled to produce the reservoir arrangement.

As shown in FIGS. 2 and 3, the ink jet printhead 16 includes a housing 58 containing a reservoir 60 in the form of an internal cavity 61 in the housing 58 which receives ink through the supply conduit 14 for replenishment when necessary. As shown in FIG. 3, the supply conduit is connected to a filter 62 inserted in an internal passage 64 which communicates with the reservoir cavity 61.

In order to heat hot melt ink contained in the reservoir, a heater element 66 received in a cylindrical recess 67 in the housing is connected through lines 68 in the cable 15 to the temperature control unit 22 and, to avoid overheating, a thermal fuse assembly 69 connected through corresponding lines 70 to the temperature control unit 22 is arranged to interrupt the supply of power to the heater 66 in the event of an overheat condition. The temperature of the ink in the printhead is maintained at a level determined by a temperature detecting thermistor 71 coupled through lines 72 to the temperature control unit 22.

In order to detect a low ink condition in the reservoir 60, and thereby initiate replenishment through the line 14, a low ink sensor 74 is positioned within the reservoir cavity 61, as shown in FIG. 2, at a location such that it will be covered with ink in any of the three mutually orthogonal printhead orientations described above until the volume of ink within the reservoir has been reduced to approximately one-half to one-third of its normal capacity. When that condition occurs, the low ink sensor 74 sends a signal through corresponding lines 76 to the pump 53 to transfer ink from the supply reservoir 12 to the printhead reservoir 60.

To convey ink from the reservoir 60 to the array of orifices 30 in any of the three mutually orthogonal orientations of the printhead 16, the reservoir 60 includes a triangular passage 78 at one end of the cavity 61 leading to an outlet 80 disposed in spaced relation to a lower corner of the cavity 61. The passage 78 thus communicates with the corner of the reservoir cavity which is at the lowest level in any of the three printhead orientations described above with respect to FIG. 1. As seen in FIG. 2, the passage 78 and the outlet 80 are at the lower right front portion of the reservoir 60. The outlet 80 leads to a duct 81 which conveys ink to adjacent pressure chambers of the conventional type (not shown) associated with each of the orifices 30 to cause ink drops to be ejected therefrom in response to ink ejection signals in the usual manner.

Thus, when the printhead is in the vertical orientation illustrated in FIG. 2 and facing the surface 37 of a package 34 as shown in dotted lines in FIG. 1, the lower portions of the passage 78 and the outlet 80 are in line with the lower part of the reservoir cavity 61. Moreover, when the printhead is in the horizontal orientation shown in solid lines in FIG. 1, i.e., with the orifices 30 facing the tope of a package 34, the passage 78 and the outlet 80 are also at a location corresponding to the lower part of the reservoir cavity 61. Finally, when the printhead is pivoted upwardly from the orientation shown in solid lines in FIG. 1 to face the labels 38 on the tape 40 as shown in dotted lines in FIG. 1, the passage 78 and the outlet 80 are located below the level of ink in the reservoir cavity 61.

As ink is used during the operation of the printhead, the level of the ink in the reservoir falls and, as a result, air is drawn into the reservoir through a vent 82 which is connected through the line 19 to the pressure control unit 18 in the control unit 10. In accordance with the invention, the vent 82 enters the reservoir cavity 61 at a location diametrically opposite the triangular passage 78 and the outlet 80, i.e. in the upper left rear portion of the reservoir as seen in FIG. 2. Within the reservoir cavity the vent 82 is connected to the upper end of one leg 84 of a U-shaped tube 86 which, as best seen in FIG. 3, consists of an upper portion with two parallel legs 84 and 88 and a lower portion 90 connecting the legs 84 and 88 and extending in a substantially horizontal direction. As seen in FIG. 2, the leg 84 extends downwardly from the vent 82 along the rear wall of the reservoir cavity 61 and the lower portion 90 extends along the bottom wall of the reservoir cavity, i.e. below the normal minimum level of ink in the reservoir, while the other leg 88 extends upwardly along the rear wall adjacent to the leg 84 with the end of the leg 88 having an end 92 which is open to the atmosphere within the reservoir.

When the printhead reservoir 60 is in its normally full condition after having been filled with ink from the remote ink supply reservoir 12, the ink level is located below the open end 92 of the U-shaped tube in each of the three printhead orientations described above so that ink will not be caused to enter the open end 92 of the U-shaped tube during normal operation in any of those orientations. As previously mentioned, if the angular position of the printhead is changed to vary the angle of the line of orifices 30 with respect to the direction of motion of the objects to be printed, the maximum level of ink in the reservoir should be controlled so that it is below the open end 92 of the U-shaped tube.

Nevertheless, it is possible that the printhead could be turned during handling or adjusting so that the open end of the U-shaped tube is below the level of ink or the reservoir could be shaken so that ink enters the open end of the U-shaped tube. In order to prevent ink which thus enters the U-shaped tube from being drawn into the vacuum and pressure line 19 connected to the vent 82, the inner diameter of the passage in the U-shaped tube is made small enough, i.e. less than about 3 mm diameter, to cause the ink to form a plug, preventing passage of air. In this way, when operation of the printhead draws ink from the reservoir 60, the resulting pressure reduction in the airspace in the reservoir will draw the ink out of the open end 92 of the U-tube and back into the reservoir.

Moreover, the length of the U-shaped tube is made great enough so that, if tilting or inversion of the printhead causes the open end 92 of the U-shaped tube to be below the level of the ink in the reservoir, the bottom end 90 of the U-shaped tube which joins the legs 84 and 88 will at the same time be at least partially above the level of the ink in the reservoir. This produces a differential pressure which tends to prevent the ink from passing farther into the tube and avoids siphoning of the ink from the reservoir into the vent and the associated pressure or vacuum line.

In a typical reservoir arrangement in accordance with the invention, the reservoir 60 has a cavity 61 which is approximately 4.5 cm high, 2.5 cm wide and 2.5 cm deep and a triangular passage 78 which is about 2.5 cm long, 2 cm high at its large end, and 0.3 cm wide. In this case, the normal capacity of the reservoir is approximately 30 cc and the low ink sensor 74 is positioned to indicate a low ink condition with about 10–15 cc of ink remaining in the reservoir in each of the three orientations described above. Moreover, with the triangular passage 78 and the reservoir outlet 80 at the location described above, the volume of ink remaining in the reservoir can be reduced to approximately 10% of its normal capacity, i.e. about 3 cc, before air could be drawn into the duct leading to the ink jet orifices 30.

Although the invention has been described herein with reference to a specific embodiment, many modifications and variations therein will readily occur to those skilled in the art. Accordingly, all such variations and modifications are included within the intended scope of the invention.

I claim:

1. An ink jet printhead adapted to be positioned in orthogonal orientations comprising an array of orifices to eject ink drops in a selected direction, support means for supporting the printhead in at least two orthogonal orientations, the printhead containing a reservoir therein for supplying ink to the array of orifices in the ink jet head, an ink outlet which is located in a lower portion of the reservoir with the printhead oriented in each of the orthogonal orientations, a vent for supplying air to the reservoir, and a U-shaped tube having a first end connected to the vent and having a second end at a location which is above the level of ink in the reservoir with the reservoir oriented in each of the orthogonal orientations, the U-shaped tube also having a central portion extending below the first and second ends and below the level of ink in the reservoir in each of the orthogonal orientations.

2. An ink jet printhead according to claim 1 including a pressure control line connected to the vent for applying pressure to the vent at a controlled negative or positive pressure level.

3. An ink jet printhead according to claim 1 including low ink sensor means disposed within the reservoir at a location selected to indicate a low ink condition in each of the orthogonal orientations of the reservoir.

4. An ink jet printhead according to claim 3 wherein the low ink sensor means is disposed within the reservoir at a location selected to indicate a low ink condition for an ink level in the reservoir between about one-third and one-half of the reservoir capacity in each of the orthogonal orientations.

5. An ink jet printhead according to claim 1 including a cylindrical ink supply passage in the printhead for supplying ink to the reservoir passage and a cylindrical filter received in the supply passage.

6. An ink jet printhead according to claim 1 including heater means for heating ink in the printhead and temperature detector means for detecting the temperature of the printhead and controlling the heater means in accordance therewith.

7. An ink jet printhead according to claim 6 including thermal fuse means for disabling the heater means in response to an excessive temperature condition in the printhead.

8. An ink jet printhead according to claim 1 wherein the support means is arranged to support the printhead in any of three mutually orthogonal orientations.

9. An ink jet system comprising an an array of orifices to eject ink drops in a selected direction, support means for supporting the printhead in each of at least two orthogonal orientations to permit ink drops to be ejected in corresponding orthogonal directions, a reservoir within the printhead having an outlet which is disposed at a portion of the reservoir which is below the level of the ink in each of the orthogonal orientations of the printhead to supply ink to the array of orifices therein, a vent for supplying air to the reservoir and a U-shaped tube within the reservoir having a first end connected to the vent and a second end open to the atmosphere in the reservoir and disposed in a region which is above the level of ink in each of the orthogonal orientations of the printhead, the U-shaped tube having a portion extending to a region which is below the first and second ends and below the level of the ink in the reservoir in each of the orientations of the ink jet head, and a remote ink supply connected to the printhead reservoir.

10. An ink jet system according to claim 9 including an ink level sensor in the printhead reservoir for detecting a low ink condition in each of the plurality of orientations of the ink jet printhead and causing the remote ink supply to supply ink to the printhead reservoir in response to detection of a low level condition by the sensor.

11. An ink jet system according to claim 10 wherein the ink level sensor is disposed in the printhead reservoir at a location to detect a low ink condition for an ink level between about one-half and about one-third of the reservoir capacity in each of the orthogonal orientations of the ink jet head.

12. An ink jet system according to claim 9 wherein the U-shaped tube has an internal diameter no more than about 3 mm.

13. An ink jet system according to claim 9 wherein the U-shaped tube has parallel legs which extend along a first wall of the reservoir and a central portion joining the legs and extending along a second wall of the reservoir toward a wall of the reservoir opposite to the first wall.

14. An ink jet system according to claim 13 wherein the central portion of the U-shaped tube is disposed so as to extend above the level of the ink in the reservoir in an is inverted condition of the reservoir with respect to each of the orthogonal orientations.

15. An ink jet system according to claim 9 including pressure control means for producing positive or negative pressure and a vacuum or pressure line connecting the reservoir vent to the pressure control means.

16. An ink jet system according to claim 9 including heater means for heating ink in the printhead reservoir and temperature control means for controlling the temperature of the ink in the reservoir at a desired level.

17. An ink jet system according to claim 16 including fuse means for disabling the heater means if the temperature of the ink in the reservoir exceeds a selected level.

* * * * *